United States Patent [19]

Morimoto et al.

[11] Patent Number: 4,539,282

[45] Date of Patent: Sep. 3, 1985

[54] ELECTROPHOTOGRAPHIC PHOTOCONDUCTIVE ELEMENTS

[75] Inventors: Junichi Morimoto; Fumio Kawamura; Akira Watanabe; Yoshio Suzuki; Masamichi Kawamura, all of Shizuoka, Japan

[73] Assignee: Tomoegawa Paper Manufacturing Company Limited, Tokyo, Japan

[21] Appl. No.: 563,437

[22] Filed: Dec. 20, 1983

[30] Foreign Application Priority Data

Dec. 23, 1982 [JP] Japan ..... 57-224894

[51] Int. Cl.[3] ..... G03G 5/00; G03G 5/04; G03G 5/08

[52] U.S. Cl. ..... 430/59; 430/88; 430/89; 430/91

[58] Field of Search ..... 430/88, 89, 91

[56] References Cited

U.S. PATENT DOCUMENTS

| | | | |
|---|---|---|---|
| 3,041,167 | 6/1962 | Blakney et al. | 430/125 |
| 3,052,540 | 4/1959 | Greig | 430/91 |
| 3,060,134 | 10/1962 | Elder et al. | 430/87 |
| 3,982,938 | 9/1976 | Honto et al. | 430/91 X |
| 4,218,247 | 8/1980 | Hara et al. | 430/83 X |
| 4,297,425 | 10/1981 | Pai et al. | 430/59 X |
| 4,304,829 | 12/1981 | Limburg et al. | 430/59 |
| 4,337,305 | 5/1982 | Beretta et al. | 430/83 |
| 4,346,158 | 8/1982 | Pai et al. | 430/96 X |

FOREIGN PATENT DOCUMENTS 55-60953 5/1980 Japan .
56-65141 6/1981 Japan .
56-125746 10/1981 Japan .

*Primary Examiner*—John E. Kittle
*Assistant Examiner*—Mukund J. Shah

[57] ABSTRACT

Electrophotographic photosensitive element using zinc oxide in a photosensitive layer thereof formed in conductive support are described. Zinc oxide is used in combination with polycarbonate binder and a compound of the specific type. The compound is represented by the formula

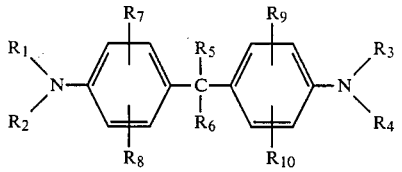

in which $R_1$, $R_2$, $R_3$ and $R_4$ independently represent a hydrogen atom, a substituted or unsubstituted alkyl group, a cycloalkyl group, an alkenyl group, or an aryl group, $R_5$ and $R_6$ independently represent a hydrogen atom, a substituted or unsubstituted alkyl group, a cycloalkyl group, an alkenyl group, a cycloalkenyl group, or an aryl group, $R_7$, $R_8$, $R_9$ and $R_{10}$ independently represent a hydrogen atom, a hydroxyl group, a substituted or unsubstituted alkyl group, a cycloalkyl group, an alkenyl group, an aryl group, an alkoxy group or an amino group. Optionally, $R_5$ and $R_6$ may jointly form a saturated or unsaturated hydrocarbon ring having from 3 to 10 carbon atoms.

9 Claims, No Drawings

ELECTROPHOTOGRAPHIC PHOTOCONDUCTIVE ELEMENTS

BACKGROUND OF THE INVENTION

1. Field of the Invention

This invention relates to the electrophotographic art and more particularly, to electrophotographic photosensitive elements comprising zinc oxide as a photoconductive material.

2. Description of the Prior Art

As is well known, a number of photoconductive materials have been used in electrophotographic photosensitive elements, including amorphous selenium alloys, zinc oxide, cadmium sulfide, and organic photoconductors. Among them, zinc oxide has a number of advantages: because the oxide itself has no toxicity, photosensitive elements comprising the oxide show no toxicity; the oxide is inexpensive and can be applied by any known coating techniques; it is easy to apply the coating on large areas; images of good quality can be obtained; spectral response of photosensitivity can be suitably controlled; and the oxide is electrically chargeable and photosensitive in both negative and positive modes. In recent years, there have arisen serious problems of the effect of chemical substances on human body and of environmental pollution. This is also true for photosensitive materials. In currently employed photosensitive materials or elements including starting materials, it is only zinc oxide that is confirmed as ecologically innocuous. In this sense, zinc oxide has been recently revaluated.

Zinc oxide photosensitive elements have been heretofore fabricated by forming, on conductive support, a photoconductive layer which is made of zinc oxide powder sensitized with organic dye sensitizers and organic polymer binders.

Electrophotographic properties of zinc oxide photosensitive elements are greatly influenced by the types of zinc oxide, dye sensitizer and resin binder contained in the photoconductive layer and the mixing ratio of these constituents. The resin binder used in the zinc oxide photosensitive element usually contains therein given amounts of electron-acceptive polar groups such as carboxyl group, hydroxyl group, epoxy group, silanol group and the like. These polar groups serve to improve the dispersability and fluidity of coating paint for the photoconductive layer by interaction with the surface of zinc oxide. Once the photosensitive element is formed, the interaction between the zinc oxide surface and the polar groups contributes to control a charge acceptance and a photosensitivity. With regard to the mixing ratio of resin binder, when a mixing ratio of a resin binder to zinc oxide is too low, potential stability of a photosensitive element in repeated use and mechanical strength of the photosensitive layer are undesirably lower. On the other hand, when a mixing ratio of resin binder is too high, a practical level of photosensitivity cannot be obtained. For the reasons described above, resin binders which are employed in known zinc oxide photosensitive elements should essentially contain given amounts of electron-acceptive groups as indicated above. Moreover, an amount of resin binder is limited to a range of 10 to 40 wt % based on zinc oxide.

The vital drawback of zinc oxide photosensitive elements is that their durability is very low. Selenium photosensitive elements or cadmium sulfide photosensitive elements have a durability corresponding to 20,000 to 100,000 copies but zinc oxide photosensitive elements have a durability of as small as 500 to 2,500 copies.

The reason why the durability of zinc oxide photosensitive element is so low is considered as follows: electrical, chemical and photochemical degradations take place due to repetitions of a charging and exposing cycle; and physical and mechanical degradations occur due to repetitions of a development-transfer-cleaning cycle. The former degradation involves (1) degradation caused by corona discharging current, (2) degradation by oxidation of dye and binder with ozone, (3) degradation by oxidation dye and binder with singlet oxygen, (4) degradation by oxidation of dye and binder with photo-generated positive holes, and (5) degradation by oxidation of dye and binder with OH radicals. The latter degradations likewise involve (1) destruction of the surface of photoconductive layer by developer, transfer paper and cleaner, and (2) filming of toner. The photosensitive material or element degraded by these factors is found to involve a number of disadvantages such as a decreasing of surface potential, an increase of dark decay rate, a lowering of photosensitivity, an increase of residual potential, and a remarkable pre-exposure effect. The resulting image will have defects such as a lowering of image density, increasing of background density, a decreasing of image contrast, remaining of residual image, occurrence of white spots and a fading of photosentive element. Of these defects or factors, the durability of zinc oxide photosensitive material depend on degradation of dye sensitizer and mechanical destruction of the photosensitive material.

In order to avoid the above problem, a number of techniques for improving the repeated durability of zinc oxide photosensitive elements have been recently proposed. For instance, there are proposed the following techniques:

(1) zinc oxide particles are encapsulated with compositions comprising dye sensitizers (Japanese Laid-open Patent Application No. 54-99635);

(2) an insulative protection layer is formed on a zinc oxide photoconductive layer (Japanese Patent Publication No. 57-19780);

(3) a mixing ratio of resin binder is increased (Japanese Laid-open Patent Application No. 56-65141); and (4) poly-N-vinylcarbazole (PVK) is used as a resin binder for zinc oxide (Japanese Laid-open Patent Application No. 56-125746).

However, all the known techniques have the respective drawbacks. In (1), capsulation conditions are very severe in order to obtain good photosensitivity. In (2), in order to form an electrostatic latent image on a photosensitive material, it is necessary to use techniques disclosed, for example, in U.S. Pat. No. 3,041,167, Japanese Patent Publication Nos. 42-19748, 42-25223, 43-1552, 47-17871 and 48-2965. This involves a complicated process copying machine. In (3), durability in repeated use is unsatisfactory. In (4), photosensitivity is unsatisfactory.

A second problem involved in zinc oxide photosensitive elements is applicability of the elements to various cleaning mechanisms and particularly to a blade cleaning apparatus. In zinc oxide photosensitive elements, it is usual that the photoconductive layer contains 10 to 50% of voids therein and has irregularities of 2–10 microns in height on the surface thereof. Accordingly, the zinc oxide photosensitive element is low in mechanical strength, so that it was difficult to apply a blade cleaning system to the element.

A third problem involved in the zinc oxide photosensitive element is its low photosensitivity. A photosensitive layer obtained by dispersing photoconductive pigments such as zinc oxide in resin binder shows a so-called induction effect in photo-induced discharge curves in which attenuation of the surface potential decay immediately after light irradiation is delayed, thus causing the sensitivity to be lowered (Electrophotography of Japan, Vol. 20, page 60 (1982)).

Zinc oxide photosensitive elements may be imparted with charge acceptance and photo-response in both positive and negative charging polarities. For instance, the following techniques are known in the art.

(1) Zinc oxide which is thermally treated in hydrogen sulfide is used (U.S. Pat. No. 3,060,134).

(2) Zinc oxide which is thermally treated in the presence of hydrogen sulfide and ammonia gas is used (Japanese Patent Publication No. 53-20856).

(3) Inorganic salts of manganese or cobalt are incorporated in photoconductive layer (Japanese Patent Publication No. 52-3303).

(4) Organic manganese compounds are incorporated in photoconductive layer (Photographic Science and Engineering, Vol. 16, page 231 (1972)).

(5) A copolymer comprising 50 to 95% of an alkyl acrylate and 1 to 5% of an organic acid having vinyl group is used as a binder (Japanese Patent Publication No. 51-16148).

In order to impart positive charge acceptance and photo-response to zinc oxide photosensitive elements, there is known the following technique.

(6) A photosensitive material is provided which comprises a two-layer structure composed of a charge-generating layer containing a sensitizing dye, and a charge transfer layer of zinc oxide powder bonded by a resin having a refractive index not smaller than 1.59 (Japanese Laid-open Patent Application No. 55-60953).

However, these known techniques (1) through (6) have, respectively, preparatory and/or characteristic problems. For instance, in (1) and (2), the treatment of zinc oxide with toxic hydrogen sulfide needs a specific apparatus. An allowance range for the treating conditions for zinc oxide is very limited in order to obtain good photosensitivity. In (3) and (4), when amounts of additives are increased so as to impart positive chargeability, photosensitivity lowers. The photosensitive material of (5) is poor in photosensitivity. In (6), formation of the two-layer structure of the charge-generating layer and the charge transfer layer by coating involves a difficulty from the manufacturing standpoint. The characteristic problem common to the known techniques is that photosensitivity of photosensitive elements is so low that their use is limited only to a so-called Electrofax ® system for copying machines of the direct system. In other words, the elements cannot be used in PPC xerographic system in which repeated use is possible.

SUMMARY OF THE INVENTION

It is accordingly an object of the present invention to provide a zinc oxide photosensitive element which is excellent in electrical and chemical stabilities and mechanical strength and which is much improved in durability in repeated use.

It is another object of the invention to provide a zinc oxide photosensitive element which is suitably applied to a xerographic machine having a blade cleaning mechanism.

It is a further object of the invention to provide a zinc oxide photosensitive element which does not show any induction effect in photo-induced discharge curves.

It is a still further object of the invention to provide a zinc oxide photosensitive element which has charge acceptance and photo-response in both positive and negative charging polarities and exhibits excellent durability when repeatedly used.

It is an additional object of the invention to provide a zinc oxide photosensitive element which is made without use of any specific materials and any specific manufacturing steps.

The above objects can be achieved, according to the present invention, by an electrophotographic photosensitive element which comprises a conductive support and at least a photosensitive layer formed on the conductive support, the photosensitive layer comprising zinc oxide, a polycarbonate binder, and a compound of the general formula (I)

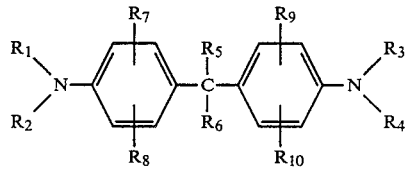

(I)

in which $R_1$, $R_2$, $R_3$ and $R_4$ independently represent a hydrogen atom, a substituted or unsubstituted alkyl group, a cycloalkyl group, an alkenyl group, or an aryl group, $R_5$ and $R_6$ independently represent a hydrogen atom, a substituted or unsubstituted alkyl group, a cycloalkyl group, an alkenyl group, a cycloalkenyl group, or an aryl group, $R_7$, $R_8$, $R_9$ and $R_{10}$ independently represent a hydrogen atom, a hydroxyl group, a substituted or unsubstituted alkyl group, a cycloalkyl group, an alkenyl group, an aryl group, an alkoxy group or an amino group, and $R_5$ and $R_6$ may jointly form a saturated or unsaturated hydrocarbon ring having from 3 to 10 carbon atoms.

The compound of the general formula (I) is usually used in an amount of from 5 tc 500 parts by weight per 100 parts by weight of the zinc oxide.

In the formula (I), it is preferred that $R_1$, $R_2$, $R_3$ and $R_4$ independently represent an ethyl group or a benzyl group, $R_5$, $R_8$ and $R_{10}$ independently represent hydrogen, $R_6$ represents a phenyl group, and R7 and R9 independently represent a methyl group.

The zinc oxide used in the electrophotographic photosensitive element may be treated with a sensitizing dye.

DETAILED DESCRIPTION AND PREFERRED EMBODIMENTS OF THE INVENTION

We have made intensive studies on resin binders for zinc oxide photosensitive elements. As a result, it was found that when a polycarbonate which has a very small content of electron-acceptive functional groups such as carboxyl group, hydroxyl group, epoxy group, silanol group and the like is used as a binder in combination with a compound of the general formula (I) and zinc oxide, the resulting zinc oxide photosensitive element showed characteristics completely different from known zinc oxide photosensitive elements.

The photosensitive elements according to the invention have the following features.

(1) Positive and negative chargeability of the elements varies depending on the weight ratio of the compound (I) to zinc oxide.

(2) Photosensitivity of positively charged photosensitive elements increases with an increase in amount of the compound (I). On the other hand, photosensitivity of negatively charged elements does not change on the addition of the compound (I). Moreover, photosensitivity of positively or negatively charged elements does not change when the ratio by weight of polycarbonate and zinc oxide is in the range of 5/100 to 200/100.

(3) The induction effect by photo discharge disappears.

These features or effects are considered to result from a combination of zinc oxide, polycarbonate and the compound (I). Photosensitive elements using hitherto employed resin binders such as acryl resins, silicone resins, epoxy resins and vinyl chloride-vinyl acetate copolymers do not show any such effects.

The polycarbonate resin used in the practice of the invention is a polyester having a carbonic acid ester in the structural unit thereof and may be prepared by an ester interchange method, a phosgene method or a self-polycondensation method. Preferably, the polycarbonate should have repeating units of the formula

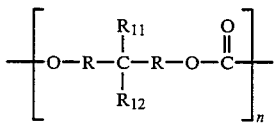

in which each R represents an unsubstituted phenylene group and a phenylene group substituted with a halogen or alkyl group, $R_{11}$ and $R_{12}$ independently represent a hydrogen atom, a substituted or unsubstituted alkyl group or a substituted or unsubstituted aryl group. $R_{11}$ and $R_{12}$ may jointly form a saturated or unsaturated hydrocarbon ring having 3 to 19 carbon atoms.

Specific examples of the polycarbonate suitable for the purpose of the invention are as follows.

(1) Poly(4,4'-dioxydiphenylcarbonate)
(2) Poly(4,4'-dioxydiphenylmethanecarbonate)
(3) Poly(4,4'-dioxydiphenyl-1,1-ethanecarbonate)
(4) Poly(4,4'-dioxydiphenyl-1,2-ethanecarbonate)
(5) Poly(4,4'-dioxydiphenyl-2,2-propanecarbonate)
(6) Poly(4,4'-dioxydiphenyl-1,1-butanecarbonate)
(7) Poly(4,4'-dioxydiphenyl-2,2-butanecarboante)
(8) Poly(4,4'-dioxydiphenyl-1,1-isobutanecarbonate)
(9) Poly(4,4'-dioxydiphenyl-1,1-cyclohexanecarbonate)
(10) Poly(4,4'-dioxy-2,2'-dimethyldiphenyl-2,2-propanecarbonate)

Examples of the compound of the general formula (1) suitable for the purpose of the invention are indicated below.

C1 1,1-bis(4-N,N-dimethylaminophenyl)-1-phenylmethane
C2 1,1-bis(4-N,N-dimethylamino-2-methylphenyl)-1-phenylmethane
C3 1.1-bis(4-N,N-dimethylamino-2-methylphenyl)-1-(2-chlorophenyl)methane
C4 1,1-bis(4-N,N-dimethylamino-2-methylphenyl)-1-(4-methoxyphenyl)methane
C5 1,1-bis(4-N,N-dimethylaminophenyl)-1-(4-hydroxyphenyl)methane
C6 1,1-bis(4-N,N-dimethylaminophenyl)-1-(2,4-dimethoxyphenyl)methane
C7 1,1-bis(4-N,N-dimethylamino-2-ethylphenyl)-1-phenylmethane
C8 1,1-bis(4-N,N-dimethylamino-2-methoxyphenyl)-1-phenylmethane
C9 1.1-bis(4-N,N-dimethylamino-2-ethoxyphenyl)-1-phenylmethane
C10 1,1-bis(4-N,N-diethylaminophenyl)-1-phenylmethane
C11 1,1-bis(4-N,N-diethylamino-2-methylphenyl)-1-phenylmethane
C12 1,1-bis(4-N,N-diethylamino-2-methylphenyl)-1-(2-chlorophenyl)methane
C13 1,1-bis(4-N,N-diethylamino-2-methylphenyl)-1-(4-methoxyphenyl)methane
C14 1,1-bis(4-N,N-diethylaminophenyl)-1-(4-hydroxyphenyl)methane
C15 1,1-bis(4-N,N-diethylaminophenyl)-1-(2,4-dimethoxyphenyl)methane
C16 1,1-bis(4-N,N-diethylamino-2-ethylphenyl)-1-phenylmethane
C17 1,1-bis(4-N,N-diethylamino-2-methoxyphenyl)-1-phenylmethane
C18 1,1-bis(4-N,N-diethylamino-2-ethoxyphenyl)-1-phenylmethane
C19 1,1-bis(4-N,N-diethylamino-2-methylphenyl)-1-(2,6-dichlorophenyl)methane
C20 1.1-bis(4-N,N-diethylamino-2,5-dimethoxyphenyl)-1-phenylmethane
C21 1,1-bis(4-N,N-dibenzylaminophenyl)-1-phenylmethane
C22 1,1-bis(4-N,N-dibenzylamino-2-methylphenyl)-1-phenylmethane
C23 1,1-bis(4-N,N-dibenzylamino-2,5-dimethylphenyl)-1-phenylmethane
C24 1,1-bis(4-N,N-dibenzylamino-2-methoxyphenyl)-1-phenylmethane
C25 1,1-bis(4-N,N-dimethylamino-2-methylphenyl)-1-(2,4-dimethoxyphenyl)methane
C26 1,1,1-tris(4-N,N-dimethylaminophenyl)-1-phenylmethane
C27 1,1,1-tris(4-N,N-dimethylamino-2-methylphenyl)methane
C28 1,1-bis(4-N,N-diethylamino-2,5-dimethylphenyl)-1-(4-N,N-dimethylaminophenyl)methane
C29 1,1-bis(4-N,N-diethylamino-2-methylphenyl)-1-(4-N,N-dimethylamino-2-chlorophenyl)methane
C30 1,1-bis(4-N,N-diethylamino-2-methylphenyl)-1-(4-N,N-dimethylamino-2-methylphenyl)methane
C31 1,1-bis(4-amino-2-methylphenyl)-1-(4-N,N-dimethylaminophenyl)methane
C32 1,1-bis(4-amino-2,5-dimethylphenyl)-1-(4-N,N-dimethylaminophenyl)methane
C33 1-(4-N,N-dimethylaminophenyl)-1,1,1-triphenylmethane
C34 1-(4-N,N-diethylaminophenyl)-1,1,1-triphenylmethane
C35 1,1-bis(4-N,N-dimethylaminophenyl)-1,1-diphenylmethane
C36 1,1-bis(4-N,N-diethylaminophenyl)-1,1-diphenylmethane
C37 1,1-bis(4-N,N-dibenzylamino-2-methylphenyl)-1-cyclohexylmethane
C38 1,1-bis(4-N,N-dibenzylamino-2-methoxyphenyl)-1-cyclohexylmethane
C39 1,1-bis(4-N,N-dibenzylaminophenyl)-1-cyclohexylmethane C40 1,1-bis(4-N,N-dibenzylamino-2,5-dimethylphenyl)-1-cyclohexylmethane
C41 1,1-bis(4-N,N-dibenzylamino-2,5-dimethoxyphenyl)-1-cyclohexylmethane
C42 1,1-bis(4-N,N-diethylamino-2-methylphenyl)-1-(4-N,N-diethylaminophenyl)methane
C43 1,1-bis(4-N,N-diethylamino-2-methylphenyl)heptane
C44 1,1-bis(4-N,N-diethylamino-2-methoxyphenyl)-2-methylpropane
C45 1,1,1-tris(4-N,N-diethylamino-2-methylphenyl)methane
C46 α,α,α′,α′,-tetrakis(4-N,N-diethylamino-2-methylphenyl)-p-xylene
C47 1,1-bis(4-N,N-diethylamino-2-ethylphenyl)-2-phenylethane
C48 1,1,5,5-tetrakis(4-N,N-dimethylamino-2-methylphenyl)pentane
C49 1,1-bis(4-N,N-diethylamino-2-ethylphenyl)-4-methylcyclohexane
C50 1,1-bis(4-N,N-dimethylamino-2-methylphenyl)cyclohexane
C51 1,1-bis(4-N-ethyl-N-methylamino-2-methylphenyl)-3-methylcyclohexane
C52 1,1,2,2-tetrakis(4-N,N-diethylamino-2-methylphenyl)ethane
C53 1,1-bis(4-N,N-diethylamino-2-methylphenyl)-3-phenylpropane
C54 1,1-bis(4-N,N-dibenzylamino-2-methylphenyl)pentane
C55 1,1-bis(4-N,N-dibenzylamino-2-methoxyphenyl)-2-methylpropane
C56 1,1-bis(4-N,N-dibenzylamino-2-methylphenyl)cyclohexane
C57 1,1-bis(4-N,N-benzylamino-2-methylphenyl)propane
C58 1,1-bis(4-N,N-dibenzylamino-2-methylphenyl)normal butane
C59 1,1-bis(4-N,N-dibenzylamino-2-methoxyphenyl)-propane
C60 1,1-bis(4-N,N-dibenzylamino-2-methoxyphenyl)-normal butane
C61 1,1-bis(4-N,N-diethylaminophenyl)heptane
C62 1,1-bis(4-N,N-dimethylaminophenyl)-2-methylpropane
C63 1,1-bis(4-N,N-dibenzylaminophenyl)pentane
C64 1,1-bis(4-N,N-dibenzylaminophenyl)-2-methylpropane
C65 1,1-bis(4-N,N-dibenzylaminophenyl)cyclohexane
C66 1,1-bis(4-N,N-dibenzylaminophenyl)propane
C67 1,1-bis(4-N,N-dibenzylaminophenyl)normal butane
C68 1,1-bis(4-N,N-dibenzylamino-2,5-dimethylphenyl)-heptane
C69 1,1-bis(4-N,N-dibenzylamino-2,5-dimethylphenyl)-normal butane
C70 1,1-bis(4-N,N-dibenzylamino-2,5-dimethoxyphenyl)normal butane
C71 1,1-bis[4-N,N-di(p-tolyl)aminophenyl]cyclohexane
C72 2,2-bis[4-N,N-di(p-tolyl)aminophenyl]propane
C73 1,1-bis[4-N,N-di(p-tolyl)aminophenyl]-1-phenylethane
C74 1,1-bis[4-N,N-di(p-tolyl)aminophenyl]-1,1-diphenylethane
C75 1,1-bis[4-N,N-di(p-tolyl)aminophenyl]methane
C76 1,1-bis[4-N,N-di(p-tolyl)aminophenyl]-1-phenylmethane
C77 1,1-bis[4-N,N-di(p-tolyl)aminophenyl]-4-tert-butylcyclohexane
C78 1,1-bis[4-N,N-di(p-tolyl)aminophenyl]-2-methylpropane
C79 1,1-bis[4-N,N-di(p-tolyl)aminophenyl]ethane
C80 1,1-bis[4-N,N-di(p-tolyl)aminophenyl]-3-methylbutane
C81 1,1-bis[4-N,N-di(p-tolyl)amino-2-methylphenyl]ethane
C82 1,1-bis[4-N,N-di(p-tolyl)amino-2-methylphenyl]-cyclohexane
C83 1,1-bis(4-N,N-dibenzylaminophenyl)ethane
C84 1,1-bis(4-N,N-dibenzylaminophenyl)propane
C85 1,1-bis(4-N,N-dibenzylaminophenyl)-n-butane
C86 1,1-bis(4-N,N-dibenzylaminophenyl)-2-methylbutane
C87 1,1-bis(4-N,N-dibenzylaminophenyl)-n-hexane
C88 1,1-bis(4-N,N-dibenzylaminophenyl)-2-ethylhexane
C89 1,1-bis(4-N,N-dibenzylaminophenyl)-n-dodecane
C90 1,1-bis[4-N,N-di(p-chlorobenzyl)aminophenyl]ethane
C91 1,1-bis[4-N,N-di(o-chlorobenzyl)aminophenyl]-n-butane
C92 1,1-bis[4-N,N-di(p-bromobenzyl)aminophenyl]-n-butane
C93 1,1-bis[4-N,N-di(p-methylbenzyl)aminophenyl]-propane
C94 1,1-bis[4-N,N-di(p-nitrobenzyl)aminophenyl]-2-ethylhexane
C95 1,1-bis(4-N,N-dibenzylamino-2-methylphenyl)methane
C96 1,1-bis(4-N,N-dibenzylamino-2-ethylphenyl)methane
C97 1,1-bis[4-N,N-di(p-chlorobenzyl)amino-2-ethylphenyl]methane
C98 1,1-bis(4-N,N-dibenzylamino-2-methylphenyl)ethane
C99 1,1-bis(4-N,N-dibenzylamino-2-ethylphenyl)ethane
C100 1,1-bis(4-N,N-dibenzylamino-2-methylphenyl)-propane
C101 1,1-bis[4-N,N-di(o-chlorobenzyl)amino-2-ethylphenyl]propane
C102 1,1-bis(40N,N-dibenzylamino-2-methylphenyl)butane
C103 1,1-bis[4-N,N-di(p-chlorobenzyl)amino-2-ethylphenyl]butane
C104 1,1-bis[4-N,N-dibenzylamino-2-methylphenyl)-2-methylpropane
C105 1,1-bis[4-N,N-dibenzylamino-2-m4thoxyphenyl)-butane
C106 1,1-bis[4-N,N-dibenzylamino-2-methylphenyl)-heptane
C107 1,1,-bis[4-N,N-di(p-tolylamino)-2-methoxyphenyl]heptane
C108 1,1-bis(4-N,N-dibenzylamino-2-methylphenyl)-hexane
C109 2,2-bis(4-N,N-dibenzylamino-2-methylphenyl)butane
C110 2,2-bis(4-N,N-dibenzylamino-2-methylphenyl)-propane The electrophotographic photosensitive element of the invention can be made as follows: a mixture of a dye adsorbed, zinc oxide powder, the polycarbonate indicated before, a compound of the general formula (I) and solvents are dispersed homogeneously to obtain a coating paint for the photoconductive layer, and the coating is applied onto a conductive support and dried.

Various conductive supports may be used including, for example, plates of metals such as aluminium, nickel, chromium and the like, paper sheets or plastic films on which metals such as aluminium, nickel, palladium and the like are deposited in vacuo or sputtered, laminates of metal foils such as aluminium and paper sheets or plastic films, carbon black-containing paper, conductive paper sheets treated with organic or inorganic conductive materials, and glass plates or plastic films provided with transparent tin oxide and/or indium oxide films on the surface thereof. The conductive support may take any forms such as sheet, roll, belt, drum and the like.

As described, the photosensitive element of the invention comprises, on conductive support, a photoconductive layer made of a mixture of zinc oxide powder, polycarbonate and a compound of the general formula (I). It is very effective to provide an intermediate layer between the conductive support and the photoconductive layer. This intermediate layer serves to block free carriers from the conductive support from being injected into the photoconductive layer. It also serves as an adhesive layer for integrally combining the photoconductive layer with the conductive support. At the time of corona charging, the intermediate layer acts to prevent the photoconductive layer from dielectric breakdown caused by over current occurring during the corona discharge. The intermediate layer may be made of a number of water-soluble polymeric materials such as gelatin, casein, starch, polyvinyl alcohol, polyvinyl pyrrolidone, carboxymethyl cellulose, hydroxypropyl cellulose, water-soluble polyvinyl butyral, polyacrylic acid, polyethyleneimine, polyethylene glycol, polypropylene glycol, and the like. Of these, casein, polyvinyl pyrrolidone or water-soluble butyral resin are preferred. The intermediate layer has generally a thickness ranging from 0.5 to 10 microns.

Zinc oxide powder used in the photoconductive layer may be of the type which is ordinarily employed for the manufacture of known electrophotographic photosensitive elements. As a matter of course, known photosensitizers for zinc oxide may be used in combination. Examples of such sensitizers include triphynylmethane dyes, xanthene dyes, thiazine dyes, azine dyes, and the like. Of these, dye compounds which have the xanthene structure or triphenylmethane structure with a free acid group or lactone ring are preferred in view of their solubility and adsorptivity to zinc oxide. Specific and preferred examples of dye sensitizers are dibromofluorescein, diiodofluorescein, tetrachlorofluorescein, tetrabromofluorescein, tetraiodofluorescein, tetrachlorotetraiodofluorescein, tetrabromotetraiodofluorescein, Bromophenol Blue, Tetrabromo Phenol Blue, Tetraiodo Phenol Blue, Bromothymol Blue, Bromocresol Purple, Bromocresol Green, and the like.

The amount of the dye sensitizer is generally in the range of $10^{-3}$ to 5 parts by weight, preferably from $10^{-2}$ to 2 parts by weight, per 100 parts by weight of zinc oxide. The dye sensitizer may be adsorbed on zinc oxide by any known techniques. One of favorable adsorption techniques is a technique in which a dye is dissolved in a suitable solvent, to which is added zinc oxide. Subsequently, the mixture is dispersed, for example, in a ball mill to permit the dye to be adsorbed on the surface of the zinc oxide. From the mixture is then removed the solvent, thereby obtained a zinc oxide powder adsorbing the dye on the surface thereof (hereinafter referred to simply as dyed zinc oxide). The removal of the solvent from the mixture may be effected by filtration, heat drying, spray drying, or a technique disclosed in Japanese Patent Publication No. 56-39819.

Solvents which are employed for the preparation of a coating paint for photoccnductive layer should preferably be solvents for polycarbonate and compounds of the general formula (I). Examples of the solvents include ethers such as tetrahydrofuran, 1,4-dioxane and the like, ketones such as methyl ethyl ketone, cyclohexanone and the like, aromatic hydrocarbons such as toluene, xylene and the like, aprotic polar solvents such as N,N-dimethylformamide, acetamide, N-methylpyrrolidone, dimethylsulfoxide and the like, esters such as ethyl acetate, msthylcellosolve acetate and the like, chlorinated aliphatic hydrocarbons such as methylene chloride, 1,2-dichloroethane, chloroform and the like, chlorinated aromatic hydrocarbons such as monochlorobenzene and the like, and mixtures thereof.

The amount of polycarbonate is generally used in the range of from 5 to 400 parts by weight per 100 parts by weight of zinc oxide. Preferably, the amount of the polycarbonate is in the range of 50 parts by weight or more per 100 parts by weight of zinc oxide from the standpoint of mechanical strength and durability in repeated use. The amount of the compound of the general formula (I) is in the range not less than 5 parts by weight per 100 parts by weight of zinc oxide. Amounts less than 5 parts by weight are unfavorable because the purposes of the invention cannot be achieved.

It is preferred that when a coating paint for photoconductive layer is prepared, polycarbonate and the compound of the general formula (I) are both dissolved in solvent.

The coating paint can be prepared by any known dispersion apparatus such as ball mill, sand mill, attritor, three-roll mill, Kady mill, colloid mill and the like. The coating paint can be applied onto conductive support by various coating methods including, for example, blade coating, rod coating, knife coating, dip coating, spray coating and the like.

The photoconductive layer formed on conductive support is controlled to have a thickness of from 5 to 100 microns, preferably 10 to 50 microns.

The zinc oxide photosensitive element of the present invention has a number of advantages over known zinc oxide photosensitive elements as described below.

(1) Polycarbonate which has excellent electrical insulative property, chemical stability, film-forming property and mechanical strength is used in the element of the invention. High photosensitivity is ensured even through a mixing ratio of polycarbonate to zinc oxide is made much greater than in prior art cases. Accordingly, the photosensitive element of the invention exhibits excellent chemical stability and mechanical strength and has much improved durability in repeated use.

(2) The photosensitive element of the invention are so excellent in film strength and mechanical strength that it can suitably be adapted to a xerographic apparatus having a blade cleaning mechanism.

(3) The induction effect in photo-induced disappears by addition of compound (I), so that zinc oxide photosensitive elements of very high sensitivity can be obtained.

(4) Addition of compound (I) results in zinc oxide photosensitive elements which have charge acceptance and photosensitivity in both negative and positive modes and which are excellent in repeated durability.

(5) Zinc oxide photosensitive elements of the invention can be fabricated without resorting to any specific materials other than compound (I) and/or any specific production process.

Accordingly, the electrophotographic photosensitive elements of the invention can be applied to electrophotographic copying machine of the PPC type and especially to any PPC electrophotographic or xerographic copying machine making use of the Carlson process in which no limitation is imposed on the charging polarity. Alternatively, the elements are suitable as a photosensitive elements for the PPC microfilm reader printer in which copies are obtained from negative and positive microfilms. Still alternatively, the elements are applicable as a photosensitive element for dichromatic color duplicators or as a photosensitive element for the PPC color printer.

The present invention is described more particularly by way of examples, which should not be construed as limiting the present invention thereto.

Preparation of Dyed Zinc Oxide 1.0 part of tetraiodofluorescein was added to and dissolved in 100 parts by weight of tetrahydrofuran. To the solution was added 100 parts by weight of zinc oxide powder (Sazex 4000, made by Sakai Chem. Ind. Co., Ltd.). Then, the mixture was dispersed for 3 hours by a porcelain ball mill. The resulting coating paint was transferred to a beaker and agitated at 70° C. to completely evaporate the tetrahydrofuran. The resulting zinc oxide powder which had been dyed with tetraiodofluorescein was used as dyed or sensitized zinc oxide in the following examples and comparative examples.

EXAMPLE 1

An aqueous 10 wt% solution of water-soluble polyvinyl butyral (S-lek W201, made by Sekisui Chem. Co., Ltd.) was applied onto a laminate film of polyethylene terephthalate and aluminium on the aluminium side thereof by a blade coating method, followed by drying at 110° C. for 1 minutes to obtain a 1 micron thick intermediate layer. 10 g of polycarbonate resin (Lexan 121-111, General Electric Inc. of U.S.A.) was dissolved in 100 ml of methylene chloride, to which was added 10 g of compound C11 indicated before, followed by complete dissolution. To the solution was added 10 g of the dyed zinc oxide and the mixture was subjected to dispersion in a porcelain ball mill. The so formed composition was coated on the above intermediate layer by a blade coating method and dried at 90° C. for 1 minute. The resulting photoconductive layer had a thickness of 22 microns. The so obtained photosensitive element was allowed to stand in the dark place for 24 hours, and the charge acceptance was measured by using an electrostatic copying paper tester [Model SP-428, made by Kawaguchi Electric K.K.]. The sample was set in the tester and charged under conditions of a corona discharge voltage of ±6 KV with a scanning speed of 250 mm/sec. Immediately after the charging, potential $V_o$ [V] was measured. Thereafter, the sample was allowed to stand in the dark for 5 seconds (potential $V_5$[V]) and was then irradiated with tungsten lamp with a color temperature of 2854° K. and a illumination intensity of 2 luxes. An exposure necessary for discharging the surface potential to $V_5/2$[V], i.e. a half exposure $E_{\frac{1}{2}}$[lux.-second], was recorded as a photosensitivity. Moreover, a potential after exposure of 60 lux.second was measured as a residual potential $V_R$[V]. During exposure, the photo induced discharge rate $|dV/dT|$ was observed by a differentiation circuit to determine a time ($t_{max}$) when the discharge rate reaches its maximum. This time was used as an indicator for the induction effect. Photoconductive elements with a smaller $t_{max}$ showed less induction effect.

As a consequence, it was found that the electrophotographic photosensitive element of this example had the following good results: $V_o=+585$ V, $E_{\frac{1}{2}}=4.0$ lux.sec, $V_R=+10$ V, and $t_{max}=0.0$ second in positive charge; and $V_o=-570$ V, $E_{\frac{1}{2}}=3.9$ lux.sec $V_R=0$ V, and $t_{max}=0.0$ second in negative charge.

EXAMPLE 2

The procedure of Example 1 was repeated except that compound C22 was used instead of compound C11 and the mixing ratio of the polycarbonate and the dyed zinc oxide was changed. As a result, electrophotographic photosensitive elements 2-1 through 2-6 were made. Electrophotographic characteristics of these elements are shown in Table 1 below.

TABLE 1

| Sample No. | Ratio of Polycarbonate to Dyed Zinc Oxide | Positive Charge $V_o$[V] | Positive Charge $E_{\frac{1}{2}}$ [lux · sec] | Positive Charge $V_R$[V] | Positive Charge $t_{max}$ [sec] | Negative Charge $V_o$[V] | Negative Charge $E_{\frac{1}{2}}$ [lux · sec] | Negative Charge $V_R$[V] | Negative Charge $t_{max}$ [sec] |
|---|---|---|---|---|---|---|---|---|---|
| 2-1 | 5/100 | +560 | 3.8 | +5 | 0.0 | −580 | 3.6 | 0 | 0.0 |
| 2-2 | 25/100 | +550 | 4.1 | +5 | 0.0 | −600 | 4.0 | 0 | 0.0 |
| 2-3 | 50/100 | +580 | 4.5 | +10 | 0.0 | −560 | 4.1 | 0 | 0.0 |
| 2-4 | 100/100 | +600 | 3.7 | +8 | 0.0 | −570 | 3.6 | 0 | 0.0 |
| 2-5 | 200/100 | +570 | 4.0 | +5 | 0.0 | −600 | 3.9 | 0 | 0.0 |
| 2-6 | 400/100 | +600 | 4.8 | +20 | 0.0 | −640 | 4.6 | 0 | 0.0 |

From the results of the abova table, the photosensitive elements of this example are all excellent in the electrophotographic characteristics.

EXAMPLE 3

The procedure of Example 1 was repeated except that compound C42 was used instead of compound C11 and the mixing ratio of compound C42 and the dyed zinc oxide was changed, thereby making electrophotographic photosensitive elements 3-1 through 3-6.

The electrophotographic characteristics of the elements are shown in Table 2.

TABLE 2

| Sample No. | Ratio of Compound C42 to Dyed Zinc Oxide | Positive Charge $V_o$[V] | Positive Charge $E_{\frac{1}{2}}$ [lux · sec] | Positive Charge $V_R$[V] | Positive Charge $t_{max}$ [sec] | Negative Charge $V_o$[V] | Negative Charge $E_{\frac{1}{2}}$ [lux · sec] | Negative Charge $V_R$[V] | Negative Charge $t_{max}$ [sec] |
|---|---|---|---|---|---|---|---|---|---|
| 3-1 | 0/100 | +50 | 15.3 | +20 | 0.0 | −150 | 6.6 | 0 | 0.0 |
| 3-2 | 5/100 | +300 | 3.8 | +5 | 0.0 | −340 | 3.6 | 0 | 0.0 |
| 3-3 | 25/100 | +410 | 4.0 | +7 | 0.0 | −450 | 4.1 | 0 | 0.0 |

TABLE 2-continued

| Sample No. | Ratio of Compound C42 to Dyed Zinc Oxide | Positive Charge $V_o$[V] | $E_{\frac{1}{2}}$ [lux · sec] | $V_R$[V] | $t_{max}$ [sec] | Negative Charge $V_o$[V] | $E_{\frac{1}{2}}$ [lux · sec] | $V_R$[V] | $t_{max}$ [sec] |
|---|---|---|---|---|---|---|---|---|---|
| 3-4 | 50/100 | +490 | 3.5 | +1 | 0.0 | −530 | 3.8 | 0 | 0.0 |
| 3-5 | 100/100 | +590 | 4.4 | 0 | 0.0 | −620 | 3.7 | 0 | 0.0 |
| 3-6 | 200/100 | +830 | 4.1 | +6 | 0.0 | −800 | 4.2 | 0 | 0.0 |

From the above results, it will be seen that when compound C42 is added, positive and negative charging potentials increase in proportion to the amount of the compound. Moreover, the addition contributes to improve the sensitivity both in positive and negative charging modes and to lower the residual potential under positive charging conditions. Thus, it will be appreciated that the elements (3-2 through 3-6) of the present invention have excellent characteristics.

EXAMPLE 4

The procedure of Example 1 was repeated using compounds indicated in Table 3 instead of compound C11 , thereby making electrophotographic photosensitive elements Nos. 4-1 through 4-5 of this example. The characteristics of the elements are shown in Table 3 below.

TABLE 3

| Sample No. | Compounds Used | Positive Charge $V_o$[V] | $E_{\frac{1}{2}}$ [lux · sec] | $V_R$[V] | $t_{max}$ [sec] | Negative Charge $V_o$[V] | $E_{\frac{1}{2}}$ [lux · sec] | $V_R$[V] | $t_{max}$ [sec] |
|---|---|---|---|---|---|---|---|---|---|
| 4-1 | C 14 | +610 | 5.4 | +5 | 0.0 | −600 | 4.6 | 0 | 0.0 |
| 4-2 | C 21 | +570 | 4.6 | +8 | 0.0 | −610 | 5.0 | 0 | 0.0 |
| 4-3 | C 30 | +540 | 4.3 | +6 | 0.0 | −570 | 3.9 | 0 | 0.0 |
| 4-4 | C 45 | +600 | 3.1 | 0 | 0.0 | −590 | 3.0 | 0 | 0.0 |
| 4-5 | C 81 | +620 | 4.0 | +2 | 0.0 | −600 | 3.8 | 0 | 0.0 |

The photosensitive elements of this example were found to have excellent characteristics.

EXAMPLE 5

The procedure of Example 1 was repeated except that an aluminum drum was used instead of the support, C45 was used as compound C11 , and a dipping method was used for the coating, thereby making two electrophotographic photosensitive drums in this example. The drums were mounted in the xerographic testing apparatus having a blade cleaning mechanism and capable of arbitrarily selecting polarity for charging. By the positive charging process, the surface potential was set at +500 V, followed by the running test in repetition mode of charging-imagewise exposure-two-component dry development-transfer on ordinary paper-AC discharging with erase light-blade cleaning. As a result, it was found that good image characteristics were obtained until the above operation reached 10,000 cycles. The drum was replaced by a fresh one whose surface potential was set at −500 V by the negative charging process, followed by repeating the running test in the same manner as described above. Good image characteristics were obtained to an extent of 10,000 operation cycles.

COMPARATIVE EXAMPLE 1

The procedure of Example 1 was repeated using, instead of C11, a compound of the following formula

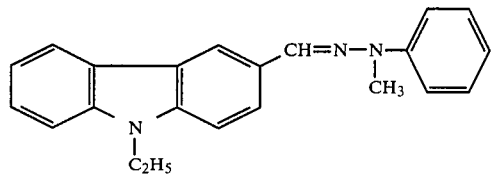

thereby making an electrophotographic photosensitive element for comparison. The element was subjected to the evaluation of electrophotographic characteristics. As a result, it was found that $V_o=+172$ V and $E_{\frac{1}{2}}>60$ lux.sec in positive charge, and $V_o=138$ V and $E_{\frac{1}{2}}=3.0$ lux.sec in negative charge. Thus, satisfactory charge acceptance could not be obtained in both polarities.

COMPARATIVE EXAMPLE 2

The procedure of Example 1 was repeated except that vinyl chloride-vinyl acetate-maleic anhydride copolymer (VMCA, by Union Carbide Co., Ltd. of U.S.A.) was used instead of the polycarbonate and a mixed solvent of isobutyl acetate and dichloromethane in a mixing ration of 1:1 was used instead of dichloromethane as the solvent. The resulting electrophotographic photosensitive element was evaluated with respect to electrophotographic characteristics. As a result, it was found that $V_o=+600$ V, $E_{\frac{1}{2}}=20$ lux.sec, $V_R=+100$ V, and $t_{max}=2.1$ seconds in positive charge and $V_o=-610$ V, $E_{\frac{1}{2}}=15$ lux .sec, $V_R=O$ V, and $t_{max}=2.1$ seconds in negative charge. Thus, photosensitivity was poor.

COMPARATIVE EXAMPLE 3

Three samples CE-1 through CE-3 were made in the same manner as in Example 1 except that undyed zinc oxide was used instead of the dyed zinc oxide, 0.1 g of tetraiodofluorescein was used instead of the dyed zinc oxide, and compound C11 was not used, respectively. The electrophotographic characteristics of the samples for comparison are shown in Table 4 below.

TABLE 4

| Sample No. | Positive Charge $V_o$[V] | Positive Charge $E_{\frac{1}{2}}$ [lux · sec] | Positive Charge $V_R$[V] [sec] | Negative Charge $V_o$[V] [lux · sec] | Negative Charge $E_{\frac{1}{2}}$ [lux · sec] | Negative Charge $V_R$[V] [sec] |
|---|---|---|---|---|---|---|
| CE-1 | +640 | >1000 | +510 | −600 | >1000 | −420 |
| CE-2 | +1220 | >1000 | +1010 | −1120 | >1000 | −950 |
| CE-3 | +70 | 20.4 | +10 | −335 | 14.1 | 0 |

A single table containing the results of Example 1 and Comparative Example 3 is set forth below:

TABLE 5

| Sample No. | Photoconductor Composition | Positive Charge Vo [v] | Positive Charge $E_{\frac{1}{2}}$ [lux · sec] | Positive Charge $V_R$ [v] | Negative Charge Vo [v] | Negative Charge $E_{\frac{1}{2}}$ [lux · sec] | Negative Charge $V_R$ [v] |
|---|---|---|---|---|---|---|---|
| CE 1 | Undyed ZnO + Polycarbonate + Compound C11 | +640 | >1000 | +510 | −600 | >1000 | −420 |
| CE 2 | Dye + Polycarbonate + Compound 11 | +1220 | >1000 | +1010 | −1120 | >1000 | −950 |
| CE 3 | Dyed ZnO + Polycarbonate | +70 | 20.4 | +10 | −335 | 14.1 | 0 |
| Example 1 | Dyed ZnO + Polycarbonate + Compound C11 | +585 | 4.0 | +10 | −570 | 3.9 | 0 |

What is claimed is:

1. An electrophotographic photosensitive element which comprises a conductive support and at least a photosensitive layer formed on said conductive support, said photosensitive layer comprising sensitizing dye treated zinc oxide, a polycarbonate binder used in an amount ranging from 5 to 400 parts by weight per hundred parts by weight of said zinc oxide, and a compound of the general formula (I) used in an amount ranging from 5 to 500 parts by weight per hundred parts by weight of said zinc oxide,

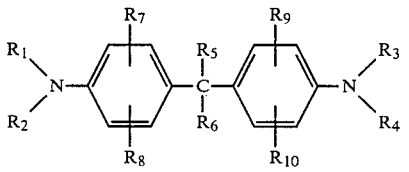

(I)

in which $R_1$, $R_2$, $R_3$ and $R_4$ independently represent a hydrogen atom, a substituted or unsubstituted alkyl group, a cycloalkyl group, an alkenyl group, or an aryl group, $R_5$ and $R_6$ independently represent a hydrogen atom, a substituted or unsubstitued alkyl group, a cycloalkyl group, an alkenyl group, a cycloalkenyl group, or an aryl group, $R_7$, $R_8$, $R_9$ and $R_{10}$ independently represent a hydrogen atom, a hydroxyl group, a substituted or unsubstituted alkyl group, a cycloalkyl group, an alkenyl group, an aryl group, an alkoxy group or an amino group, and optionally $R_5$ and $R_6$ are able to jointly form a saturated or unsaturated hydrocarbon ring having from 3 to 10 carbon atoms.

2. The electrophotographic photosensitive element according to claim 1, wherein said sensitizing dye is a member selected from the group consisting of xanthene dyes and triphenylmethane dyes.

3. The electrophotographic photosensitive element according to claim 2, wherein an amount of said sensitizing dye is in the range of $10^{-3}$ to 5 parts by weight per 100 parts by weight of said zinc oxide.

4. The electrophotographic photosensitive element according to claim 1, further comprising an intermediate layer provided between said conductive support and said photosensitive layer.

5. The electrophotographic photosensitive element according to claim 6, wherein said intermediate layer is made of casein, polyvinyl pyrrolidone or water-soluble butyral resin.

6. The electrophotographic photosensitive element according to claim 1, wherein in the formula (I), $R_1$, $R_2$, $R_3$ and $R_4$ independently represent ethyl or benzyl, $R_5$, $R_8$ and $R_{10}$ independently represent hydrogen $R_6$ represents phenyl, and $R_7$ and $R_9$ independently represent methyl.

7. The electrophotographic photosensitive element according to claim 1, wherein said polycarbonate is a polymer having repeating units of the formula

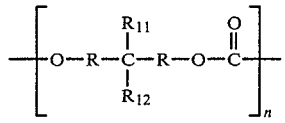

in which R represents an unsubstituted phenylene group, a halogen-substituted phenylene group or an alkyl-substituted phenylene group, and $R_{11}$ and $R_{12}$ independently represent a hydrogen atom, a substituted or unsubstituted alkyl group, or a substituted or unsubstituted aryl group, or jointly form a saturated or unsaturated hydrocarbon ring having from 3 to 19 carbon atoms.

8. The electrophotographic photosensitive element as recited in claim 1 wherein the compound of formula (I) is 1,1-bis(4-N,N-diethylamino-2-methylphenyl)-1-(4-N,N-diethylaminophenyl)methane.

9. The electrophotographic element as recited in claim 1 wherein the compound of formula (I) is 1,1-bis(4-N,N-diethylamino-2-methylphenyl)-1-phenylmethane.

* * * * *

UNITED STATES PATENT AND TRADEMARK OFFICE

CERTIFICATE OF CORRECTION

PATENT NO. : 4,539,282

DATED : September 3, 1985

INVENTOR(S) : JUNICHI MORIMOTO ET AL.

It is certified that error appears in the above—identified patent and that said Letters Patent is hereby corrected as shown below:

Claim 5, line 2, "6" should be --4--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*